US010629140B2

(12) United States Patent
Zha

(10) Patent No.: US 10,629,140 B2
(45) Date of Patent: Apr. 21, 2020

(54) PARTITIONED BACKLIGHT DISPLAY METHOD OF RED, GREEN, BLUE, AND WHITE (RGBW) DISPLAY DEVICE

(71) Applicant: WUHAN CHINA STAR OPTOELECTRONICS TECHNOLOGY CO., LTD., Wuhan, Hubei (CN)

(72) Inventor: Guowei Zha, Hubei (CN)

(73) Assignee: WUHAN CHINA STAR OPTOELECTRONICS TECHNOLOGY CO., LTD., Wuhan (CN)

( * ) Notice: Subject to any disclaimer, the term of this patent is extended or adjusted under 35 U.S.C. 154(b) by 158 days.

(21) Appl. No.: 15/574,360

(22) PCT Filed: Sep. 11, 2017

(86) PCT No.: PCT/CN2017/101159
§ 371 (c)(1),
(2) Date: Nov. 15, 2017

(87) PCT Pub. No.: WO2019/010801
PCT Pub. Date: Jan. 17, 2019

(65) Prior Publication Data

US 2019/0221171 A1 Jul. 18, 2019

(30) Foreign Application Priority Data

Jul. 14, 2017 (CN) ..... 2017 1 0576251

(51) Int. Cl.
*G09G 3/34* (2006.01)
*G09G 3/36* (2006.01)

(52) U.S. Cl.
CPC ..... *G09G 3/3426* (2013.01); *G09G 3/342* (2013.01); *G09G 3/3413* (2013.01); *G09G 3/3607* (2013.01); *G09G 2320/0242* (2013.01); *G09G 2320/0271* (2013.01); *G09G 2320/0626* (2013.01); *G09G 2320/0646* (2013.01); *G09G 2320/0686* (2013.01); *G09G 2340/06* (2013.01); *G09G 2360/16* (2013.01)

(58) Field of Classification Search
CPC ... G09G 2320/0242; G09G 2320/0626; G09G 2320/0686; G09G 2360/16
See application file for complete search history.

(56) References Cited

U.S. PATENT DOCUMENTS 6,868,179 B2 * 3/2005 Gruzdev ..... H04N 1/608 358/3.23
8,131,098 B2 * 3/2012 Watanabe ..... G06K 9/4633 345/422

(Continued)

*Primary Examiner* — William Boddie
*Assistant Examiner* — Bipin Gyawali
(74) *Attorney, Agent, or Firm* — Kirton McConkie; Evan R. Witt

(57) ABSTRACT

The present invention provides a partitioned backlight display method and device of a red, green, blue, and white (RGBW) display. Converting the RGB display to the RGBW avoids problems of pure color darkness from different pixel gain inconsistencies, independently sets saturation gain value in different partitions based on specific screens, and maximizes and enhances penetration rate of W sub-pixel brightness gain effect.

11 Claims, 2 Drawing Sheets

(56) References Cited

U.S. PATENT DOCUMENTS 8,334,876 B2 * 12/2012 Abe ..... H04N 9/3182 345/428
8,421,818 B2 * 4/2013 Abe ..... G06T 5/009 345/428
8,599,211 B2 * 12/2013 Hsieh ..... G09G 5/02 345/589
8,842,911 B2 * 9/2014 Pettigrew ..... H04N 1/60 382/162
8,860,642 B2 * 10/2014 Phan ..... G09G 3/20 345/589
8,913,094 B2 * 12/2014 Chu Ke ..... G09G 3/32 345/690
9,349,168 B2 * 5/2016 Onda ..... H04N 9/3179
9,578,296 B2 * 2/2017 Suginohara ..... G09G 3/2003
9,646,567 B2 * 5/2017 Nakanishi ..... G09G 3/3225
9,691,338 B2 * 6/2017 Kimura ..... G09G 3/3607
9,697,761 B2 * 7/2017 Li ..... G09G 3/32
9,947,268 B2 * 4/2018 Yata ..... G09G 3/3233
10,115,330 B2 * 10/2018 Li ..... G09G 3/2003
10,276,080 B2 * 4/2019 Pan ..... G09G 3/2003
10,366,673 B2 * 7/2019 Heo ..... H04N 1/6016
2005/0151752 A1 * 7/2005 Phan ..... G09G 3/2003 345/589
2009/0046307 A1 * 2/2009 Kwak ..... G09G 5/02 358/1.9
2009/0059078 A1 * 3/2009 Kim ..... G09G 3/3406 348/645
2009/0213048 A1 * 8/2009 Park ..... G09G 3/2003 345/77
2010/0207958 A1 * 8/2010 Kimura ..... H04N 5/332 345/596
2010/0225673 A1 * 9/2010 Miller ..... G09G 3/2003 345/690
2011/0013041 A1 * 1/2011 Abe ..... G06T 5/009 348/222.1
2011/0149166 A1 * 6/2011 Botzas ..... H04N 5/202 348/649
2012/0154451 A1 * 6/2012 Kao ..... G09G 5/10 345/690
2015/0109350 A1 * 4/2015 Gotoh ..... G09G 3/3607 345/690
2015/0138227 A1 * 5/2015 Zhao ..... H04N 5/57 345/601
2016/0117975 A1 * 4/2016 Kang ..... G09G 3/2003 345/694
2017/0285340 A1 * 10/2017 Harada ..... G02B 27/0101
2018/0168512 A1 * 6/2018 Ikemoto ..... A61B 5/7203
2018/0174529 A1 * 6/2018 de Greef ..... G09G 3/348
2019/0073756 A1 * 3/2019 Stessen ..... H04N 19/186

* cited by examiner

PARTITIONED BACKLIGHT DISPLAY METHOD OF RED, GREEN, BLUE, AND WHITE (RGBW) DISPLAY DEVICE

BACKGROUND OF THE INVENTION

Field of Invention

The present invention relates to displays, and particularly to a partitioned backlight display method of a red, green, blue, and white (RGBW) display device.

Description of Prior Art

Key display technology can reproduce the human eye for visual perception of nature. Current mainstream display technology includes liquid crystal display (LCD) display technology and organic light-emitting diode (OLED) display technology. The LCD display technology has clear cost and reliability advantages. And the OLED technology, as a late start display technology, still has higher costs, limited life, and other issues.

But with progress of technology and supply chain improvement, the OLED display technology has gradually narrowed the distance with the LCD display technology, and at the same time, the OLED display technology shows high color gamut advantages and high contrast advantages etc.

Dynamic partitioning backlight allows backlighting of different partitions to independently adjust brightness of partition backlights based on contents of the current display. But the adjustment of the backlight is still limited in a large range of a single partition, the pixels within any partition still share a same brightness of the backlight, it is difficult to match a self-luminous adjustment effect of a single sub-pixel of the OLED.

Four-color display technology (such as RGBW) is made by adding a white W pixels to a traditional red, green, and blue (RGB) hue arrangement, since the white pixel W usually uses a high transmittance OC flat layer instead of a low transmittance colorant layer, the RGB pixel arrangement has high brightness and low power advantages. At present, a brightness of a liquid crystal displaying module with the traditional RGB pixel arrangement is 400-500 nits, and the maximum transmittance of the W sub-pixel is about 100-150% more than that of the RGB pixel, so that the maximum brightness can be about 700-1200 nits. And, the W sub-pixel as a single sub-pixel can adjust the brightness of a single pixel at the pixel level, and has a function similar to "dynamic backlight" to make the LCD have a dynamic backlight adjustment level similar to the OLED.

It is also difficult to use a appropriate algorithm to combine a partitioned backlight and a RGBW display technology.

Therefore, the conventional technology has yet to be improved and developed.

SUMMARY OF THE INVENTION

The application mainly provides a partitioned backlight display method of a RGBW display device, thereby realizing a partitioned backlight display function of the RGBW.

For the above-mentioned objective, the present disclosure employs the following technical schemes.

A partitioned backlight display method of a RGBW display device comprises:

dividing a red, green, and blue (RGB) image into a plurality of image partitions based on a backlight partition setting information, each image partition comprising a plurality of RGB pixels;

obtaining a gray scale value of each RGB pixel and converting the gray scale value to a hue, saturation, and value (HSV) space to obtain a saturation of the RGB pixel;

determining each of the of RGB pixels being a high-purity color RGB pixel or a non-high-purity color RGB pixel based on the saturation and generating a determining result;

obtaining a saturation gain corresponding to each of the RGB pixels when each RGB pixel is pre-converted into a RGBW pixel;

obtaining a corrected target saturation gain by correcting the saturation gain of each RGB pixel based on the determining result and a visual luminance gain coefficient of each RGB pixel;

setting a saturation gain threshold corresponding to each image partition, and performing an optimization process on the target saturation gain for each RGB pixel in the image partition based on the saturation gain threshold;

obtaining a gray scale value of the RGBW pixel by converting the RGB pixel into an RGBW pixel according to the target saturation gain after the optimization process;

obtaining a target backlight luminance gain coefficient based on the gray scale value of each RGBW pixel in the image partition and the saturation gain threshold corresponding to the image partition;

obtaining a gray scale compensation screen of the image partition based on the target backlight luminance gain coefficient of the image partition and the gray scale value of the RGBW pixel in the image partition; and displaying based on the gray scale compensation screen of each the image partition.

In one exemplary embodiment, in the partitioned backlight display method of the RGBW display device, the step of obtaining a target backlight luminance gain coefficient based on the gray scale value of each RGBW pixel in the image partition and the saturation gain threshold corresponding to the image partition comprises:

setting the backlight luminance gain coefficient in the image partition based on the gray scale value of the RGBW pixel in the image partition; and obtaining the target backlight luminance gain coefficient by correcting the backlight luminance gain coefficient in the image partition based on the saturation gain threshold.

In one exemplary embodiment, in the partitioned backlight display method of the RGBW display device, the step of performing an optimization process on the target saturation gain for each RGB pixel in the image partition based on the saturation gain threshold comprises:

adjusting the target saturation gain of the RGB pixel to the corresponding saturation gain threshold when the target saturation gain of the RGB pixel of the image partition is more than the corresponding saturation gain threshold.

In one exemplary embodiment, in the partitioned backlight display method of the RGBW display device, the step of obtaining a corrected target saturation gain by correcting the saturation gain of each RGB pixel based on the determining result and a visual luminance gain coefficient of each RGB pixel comprises:

obtaining a visual luminance gain coefficient x of each RGB pixel;

the target saturation gain of the RGB pixel has n=mx, when the RGB pixel is a high-purity color RGB pixel;

the target saturation gain n=m, when the RGB pixel is a high purity color RGB pixel; and wherein, m is the saturation gain of the RGB pixel.

In one exemplary embodiment, in the partitioned backlight display method of the RGBW display device, the step of obtaining a gray scale value of each RGB pixel and converting the gray scale value to a HSV space to obtain a saturation of the RGB pixel comprises:

normalizing the RGB pixels and obtaining a gray scale values of the normalized RGB pixels; and obtaining the saturation of the RGB pixel by converting the gray scale value of the RGB pixel to the HSV space.

A partitioned backlight display device for RGBW displaying comprises:

a dividing module for dividing a RGB image into a plurality of image partitions based on a backlight partition setting information, each image partition comprising a plurality of RGB pixels;

a first obtaining module for obtaining a gray scale value of each RGB pixel and converting the gray scale value to a hue, saturation, and value (HSV) space to obtain a saturation of the RGB pixel;

a determining module for determining each of the of RGB pixels being a high-purity color RGB pixel or a non-high-purity color RGB pixel based on the saturation and generating a determining result;

a second obtaining module for obtaining a saturation gain corresponding to each of the RGB pixels when each RGB pixel is pre-converted into a RGBW pixel;

a correcting module for obtaining a corrected target saturation gain by correcting the saturation gain of each RGB pixel based on the determining result and a visual luminance gain coefficient of each RGB pixel;

an optimization module for setting a saturation gain threshold corresponding to each image partition, and performing an optimization process on the target saturation gain for each RGB pixel in the image partition based on the saturation gain threshold;

a third obtaining module for obtaining a gray scale value of the RGBW pixel by converting the RGB pixel into an RGBW pixel according to the target saturation gain after the optimization process;

a fourth obtaining module for obtaining a target backlight luminance gain coefficient based on the gray scale value of each RGBW pixel in the image partition and the saturation gain threshold corresponding to the image partition;

a fifth obtaining module for obtaining a gray scale compensation screen of the image partition based on the target backlight luminance gain coefficient of the image partition and the gray scale value of the RGBW pixel in the image partition; and a displaying module for displaying based on the gray scale compensation screen of each the image partition.

In one exemplary embodiment, in the partitioned backlight display device for RGBW displaying, the fourth obtaining module comprises:

a setting unit for setting the backlight luminance gain coefficient in the image partition based on the gray scale value of the RGBW pixel in the image partition; and a correcting unit for obtaining the target backlight luminance gain coefficient by correcting the backlight luminance gain coefficient in the image partition based on the saturation gain threshold.

In one exemplary embodiment, in the partitioned backlight display device for RGBW displaying, the optimization module comprises:

a first setting unit for setting a saturation gain threshold corresponding to each image partition; and an optimization unit for adjusting the target saturation gain of the RGB pixel to the corresponding saturation gain threshold when the target saturation gain of the RGB pixel of the image partition is more than the corresponding saturation gain threshold.

In one exemplary embodiment, in the partitioned backlight display device for RGBW displaying, the correcting module comprises:

a first obtaining unit for obtaining a visual luminance gain coefficient x of each RGB pixel;

a second setting unit for setting the target saturation gain of the RGB pixel to mx, when the RGB pixel is a high-purity color RGB pixel;

a third setting unit for setting the target saturation gain to m when the RGB pixel is a high purity color RGB pixel; and wherein, m is the saturation gain of the RGB pixel.

In one exemplary embodiment, in the partitioned backlight display device for RGBW displaying, the first obtaining module comprises:

a normalization unit for normalizing the RGB pixels and obtaining a gray scale values of the normalized RGB pixels; and a second obtaining unit for obtaining the saturation of the RGB pixel by converting the gray scale value of the RGB pixel to the HSV space.

A partitioned backlight display device for RGBW displaying comprises:

a dividing module for dividing a RGB image into a plurality of image partitions based on a backlight partition setting information, each image partition comprising a plurality of RGB pixels;

a first obtaining module for obtaining a gray scale value of each RGB pixel and converting the gray scale value to a hue, saturation, and value (HSV) space to obtain a saturation of the RGB pixel;

a determining module for determining each of the of RGB pixels being a high-purity color RGB pixel or a non-high-purity color RGB pixel based on the saturation and generating a determining result;

a second obtaining module for obtaining a saturation gain corresponding to each of the RGB pixels when each RGB pixel is pre-converted into a RGBW pixel;

a correcting module for obtaining a corrected target saturation gain by correcting the saturation gain of each RGB pixel based on the determining result and a visual luminance gain coefficient of each RGB pixel;

an optimization module for setting a saturation gain threshold corresponding to each image partition, and performing an optimization process on the target saturation gain for each RGB pixel in the image partition based on the saturation gain threshold;

a third obtaining module for obtaining a gray scale value of the RGBW pixel by converting the RGB pixel into an RGBW pixel according to the target saturation gain after the optimization process;

a fourth obtaining module for obtaining a target backlight luminance gain coefficient based on the gray scale value of each RGBW pixel in the image partition and the saturation gain threshold corresponding to the image partition;

a fifth obtaining module for obtaining a gray scale compensation screen of the image partition based on the target backlight luminance gain coefficient of the image partition and the gray scale value of the RGBW pixel in the image partition; and a displaying module for displaying based on the gray scale compensation screen of each the image partition;

wherein the fourth obtaining module comprising:

a setting unit for setting the backlight luminance gain coefficient in the image partition based on the gray scale value of the RGBW pixel in the image partition; and a correcting unit for obtaining the target backlight luminance gain coefficient by correcting the backlight luminance gain coefficient in the image partition based on the saturation gain threshold;

wherein the optimization module comprising:

a first setting unit for setting a saturation gain threshold corresponding to each image partition; and an optimization unit for adjusting the target saturation gain of the RGB pixel to the corresponding saturation gain threshold when the target saturation gain of the RGB pixel of the image partition is more than the corresponding saturation gain threshold;

wherein the correcting module comprising:

a first obtaining unit for obtaining a visual luminance gain coefficient x of each RGB pixel;

a second setting unit for setting the target saturation gain of the RGB pixel to mx, when the RGB pixel is a high-purity color RGB pixel;

a third setting unit for setting the target saturation gain to m when the RGB pixel is a high purity color RGB pixel; and wherein, m is the saturation gain of the RGB pixel; and wherein the first obtaining module comprising:

a normalization unit for normalizing the RGB pixels and obtaining a gray scale values of the normalized RGB pixels; and a second obtaining unit for obtaining the saturation of the RGB pixel by converting the gray scale value of the RGB pixel to the HSV space.

From the above, in this application, converting the RGB display to the RGBW avoids problems of pure color darkness from different pixel gain inconsistencies, independently sets saturation gain value in different partitions based on specific screens, and maximizes and enhances penetration rate of W sub-pixel brightness gain effect.

DETAILED DESCRIPTION OF THE PREFERRED EMBODIMENTS

Figure 1:
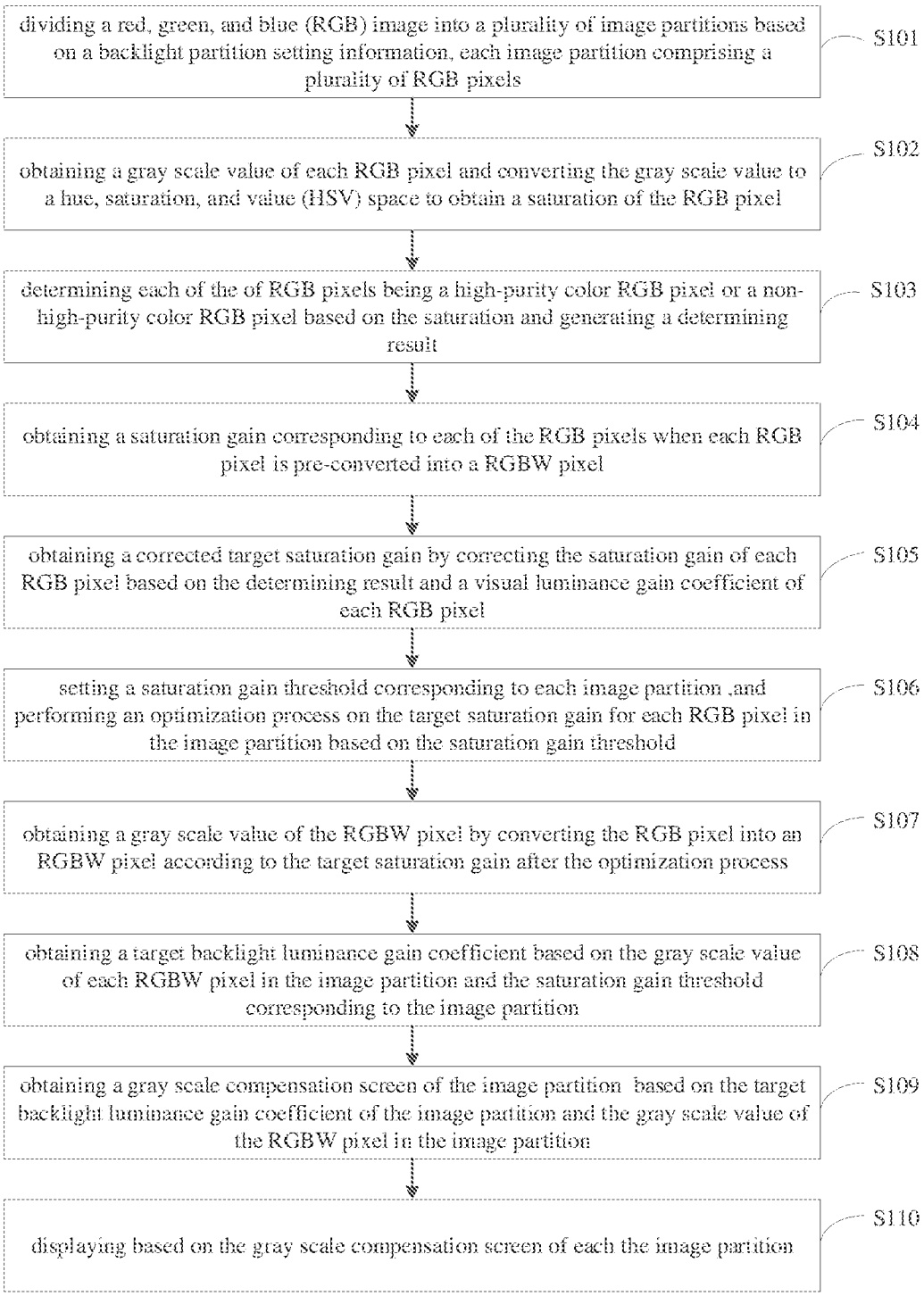
FIG. 1 is a flowchart of a partitioned backlight display method of a RGBW display device according to one exemplary embodiment of the present disclosure.

The description of following embodiment, with reference to the accompanying drawings, is used to exemplify specific embodiments which may be carried out in the present disclosure. Directional terms mentioned in the present disclosure, such as "top", "bottom", "front", "back", "left", "right", "inside", "outside", "side", etc., are only used with reference to the orientation of the accompanying drawings. Therefore, the used directional terms are intended to illustrate, but not to limit, the present disclosure. In the drawings, the components having similar structures are denoted by same numerals In the figures, modules with similar structures are denoted by the same reference numerals.

Figure 2:
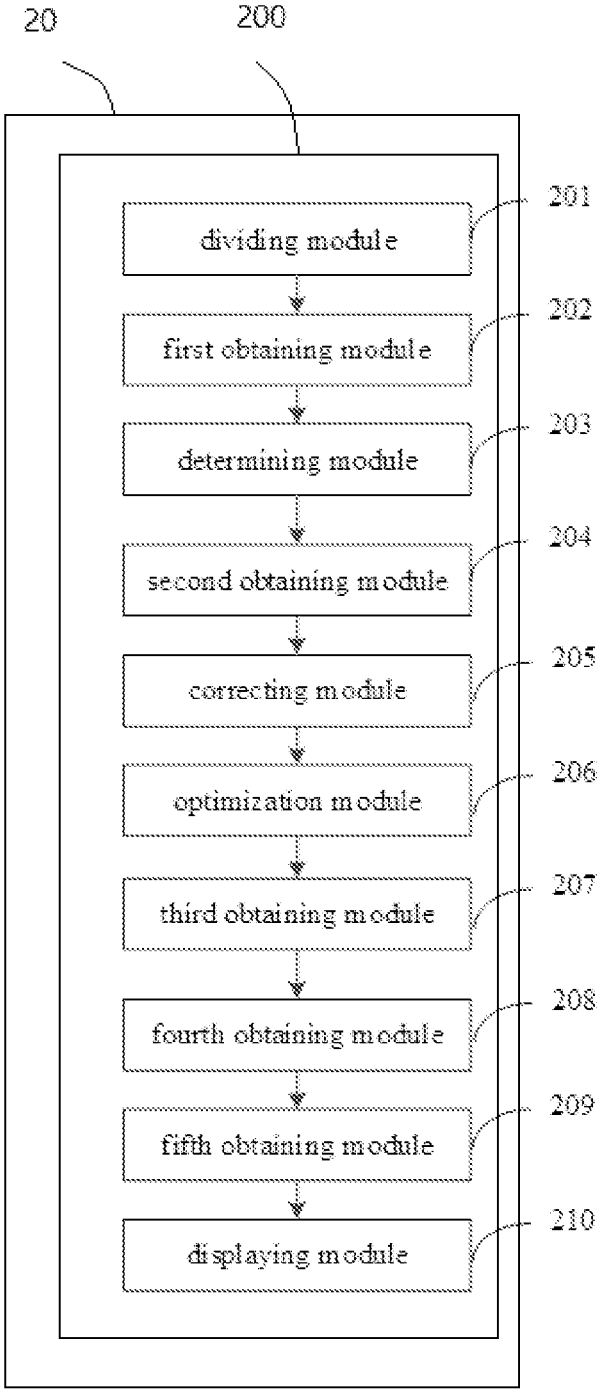
FIG. 2 is a structure diagram of a partitioned backlight display device for RGBW displaying according to one exemplary embodiment of the present disclosure.

Referring to FIGS. 1 and 2, FIG. 1 is a flowchart of a partitioned backlight display method of a RGBW display device according to one exemplary embodiment of the present disclosure, FIG. 2 is a structural diagram of a partitioned backlight display device for RGBW displaying according to one exemplary embodiment of the present disclosure. The RGBW display device 20 comprises a processor 200 configured to execute computerized code to perform a method. The method comprises:

S101, dividing a RGB image into a plurality of image partitions based on a backlight partition setting information, each image partition comprising a plurality of RGB pixels;

S102, obtaining a gray scale value of each RGB pixel and converting the gray scale value to a hue, saturation, and value (HSV) space to obtain a saturation of the RGB pixel;

S103, determining each of the of RGB pixels being a high-purity color RGB pixel or a non-high-purity color RGB pixel based on the saturation and generating a determining result;

S104, obtaining a saturation gain corresponding to each of the RGB pixels when each RGB pixel is pre-converted into a RGBW pixel;

S105, obtaining a corrected target saturation gain by correcting the saturation gain of each RGB pixel based on the determining result and a visual luminance gain coefficient of each RGB pixel;

S106, setting a saturation gain threshold corresponding to each image partition, and performing an optimization process on the target saturation gain for each RGB pixel in the image partition based on the saturation gain threshold;

S107, obtaining a gray scale value of the RGBW pixel by converting the RGB pixel into an RGBW pixel according to the target saturation gain after the optimization process;

S108, obtaining a target backlight luminance gain coefficient based on the gray scale value of each RGBW pixel in the image partition and the saturation gain threshold corresponding to the image partition;

S109, obtaining a gray scale compensation screen of the image partition based on the target backlight luminance gain coefficient of the image partition and the gray scale value of the RGBW pixel in the image partition; and S110, displaying is base on the gray scale compensation screen of the each image partition.

Describing in detail of the various steps of the partition backlight display method base on the attached drawings.

In the step S101, each RGB pixel comprises a red sub-pixel, a green sub-pixel, and a blue sub-pixel. A backlight partitioned information is set by the display contents of the screen.

In the step S102, normalizing the respective image partitions before the step of obtaining the gray scale value of each of the RGB pixels. For example, normalizing each image partition by using the normalization of the gamma conversion rule. The step S102 comprises:

S1021, obtaining a normalized gray scale value of the RGB pixels by normalizing the RGB pixels.

S1022, obtaining the saturation of the RGB pixel by converting the gray scale value of the RGB pixel to the HSV space.

Specifically, the each RGB pixel gray scale value is marked as Pic (H, L, a) before the normalization processing, each of H and L is the abscissa and the ordinate of the sub-pixel, and a is used to identify the color of the sub-pixel, for example, when a=1, the sub-pixel is a red sub-pixel, when a=2, the sub-pixel is a green sub-pixel, and when a=3, the sub-pixel is a blue sub-pixel. When gamma=2.2, the gray scale value of the normalized sub-pixel is recorded as In (H, L, a)=Pic $((H, L, a)/255)^{2.2}$.

After the normalization processing and getting the gray scale value of the normalized sub-pixel, the gray scale value of each sub-pixel is converted to the HSV space to obtain the saturation of the RGB pixel. The main screening colors are R (red), G (green), B (blue), C (cyan), M (mauve) and Y (yellow).

In the step S103, the saturation of the RGB pixel is higher than the threshold value is the high-purity color pixel, and the saturation is lower than the threshold value is the non-high-purity color pixel. Calibrating the pixels base on the above colors. The threshold value can be set with the reference image taste, and in at least one embodiment, the threshold value is set to 0.8.

In the step S104, when the RGB pixels are pre-converted to RGBW pixels to obtain the saturation gain corresponding to the sub-pixels of the respective RGB pixels, and the conversion is not performed here. The RGBW pixels include red sub-pixels, green sub-pixels, blue sub-pixels and white sub-pixels.

In the step S105, the visual luminance gain coefficients corresponding to R (red), G (green), B (blue), C (cyan), M (mauve) and Y (yellow) are set to 1.5, 1.2, 1.5, 1.35, 1.5 and 1.1. For the high-purity color pixels are timed by the visual luminance gain coefficients corresponding to R (red), G (green), B (blue), C (cyan), M (mauve) and Y (yellow), for non-high purity color pixels is timed by 1 to get the target saturation gain.

In the step S106, firstly, the target saturation gain of each RGB pixel is calculated. Then, base on the statistical situation, a saturation gain threshold gain_final of each different image partition is set, and base on the saturation threshold gain_final, the gray scale value of the RGB pixel in the image partition is optimized.

In particular, when the target saturation gain of an RGB pixel within the image partition is more than the corresponding saturation gain threshold, the target saturation gain of the RGB pixel is adjusted to the corresponding saturation gain threshold.

In the step S107, the RGB pixels is converted into an RGBW pixel according to the target saturation gain after the optimization process to obtain a gray scale value of the RGBW pixel. For one RGBW pixel, the gray scale value is recorded as ($R_{in}$, $G_{in}$, $B_{in}$, $W_{in}$).

In the step S108, the step comprises:

S1081, setting the backlight luminance gain coefficient in the image partition based on the gray scale value of the RGBW pixel in the image partition. the backlight luminance gain coefficient Blu_temp of the current partition is determined by the statistical distribution of all RGBW pixels (R, G B, W) values in the current image partition. Specifically, the maximum value or the average value of the gray scale value of the RGBW pixel of the current image partition may be referred. When the maximum value of the gray scale of all RGBW pixels in the current partition is 1, the backlight brightness gain coefficient Blu_temp=1; when the maximum value of the gray scale of all RGBW pixels in the current partition is 0, the backlight brightness gain coefficient Blu_temp=0.

S1082, obtaining the target backlight luminance gain coefficient by correcting the backlight luminance gain coefficient in the image partition based on the saturation gain threshold. The target backlight luminance gain coefficient Blu=Blu_temp/gain_final, and the backlight gain coefficient is outputted to the backlight drive unit to light up the backlight of the corresponding image partition.

In the step S109, a gray scale compensation image out (H, W, b) is calculated by the gradation values ($R_{in}$, $G_{in}$, $B_{in}$, $W_{in}$) of the converted RGBW pixels and the determined target backlight luminance gain coefficient Blu, and H is the abscissa of the sub-pixel, W is the ordinate, and b is the type that identifies the sub-pixel. For example, when b=1 is a red sub-pixel, when b=2 is a green sub-pixel, when b=3 is a blue sub-pixel, when b=4 is a white sub-pixel.

The step S110, the out (H, W, b) of each RGBW pixel is restored to a gray scale and outputted to the image controller to control the display of the image by operating gamma normalization corresponding to the de-gamma.

From the above, in this application, converting the RGB display to the RGBW avoids problems of pure color darkness from different pixel gain inconsistencies, independently sets saturation gain value in different partitions based on specific screens, and maximizes and enhances penetration rate of W sub-pixel brightness gain effect.

Referring to FIG. 2, the RGBW display device 20 comprises a processor 200 configured to execute computerized code to perform a method. The processor 200 comprises: a dividing module 201, a first obtaining module 202, a determining module 203, a second obtaining module 204, a correcting module 205, an optimization module 206, a third obtaining module 207, a fourth obtaining module 208, a fifth obtaining module 209 and a displaying module 210.

The dividing module 201 is used for dividing a red, green, and blue (RGB) image into a plurality of image partitions based on a backlight partition setting information, each image partition comprising a plurality of RGB pixel.

The first obtaining module 202 is used for obtaining a gray scale value of each RGB pixel and converting the gray scale value to a hue, saturation, and value (HSV) space to obtain a saturation of the RGB pixel. The first obtaining module comprises a normalization unit for normalizing the RGB pixels and obtaining a gray scale values of the normalized RGB pixels and a second obtaining unit for obtaining the saturation of the RGB pixel by converting the gray scale value of the RGB pixel to the HSV space.

The determining module 203 is used for determining each of the of RGB pixels being a high-purity color RGB pixel or a non-high-purity color RGB pixel based on the saturation and generating a determining result.

The second obtaining module 204 is used for obtaining a saturation gain corresponding to each of the RGB pixels when each RGB pixel is pre-converted into a RGBW pixel.

The correcting module 205 is used for obtaining a corrected target saturation gain by correcting the saturation gain of each RGB pixel based on the determining result and a visual luminance gain coefficient of each RGB pixel. The correcting module 205 comprises a first obtaining unit for obtaining a visual luminance gain coefficient x of each RGB pixel; a second setting unit for setting the target saturation gain of the RGB pixel to mx, when the RGB pixel is a high-purity color RGB pixel; a third setting unit for setting the target saturation gain to m when the RGB pixel is a high purity color RGB pixel; and m is the saturation gain of the RGB pixel.

The optimization module 206 is used for setting a saturation gain threshold corresponding to each image partition, and performing an optimization process on the target saturation gain for each RGB pixel in the image partition based on the saturation gain threshold. The optimization module 206 comprises a first setting unit for setting a saturation gain threshold corresponding to each image partition; and an optimization unit for adjusting the target saturation gain of the RGB pixel to the corresponding saturation gain threshold when the target saturation gain of the RGB pixel of the image partition is more than the corresponding saturation gain threshold.

The third obtaining module 207 is for obtaining a gray scale value of the RGBW pixel by converting the RGB pixel into an RGBW pixel according to the target saturation gain after the optimization process.

The fourth obtaining module 208 is used for obtaining a target backlight luminance gain coefficient based on the gray scale value of each RGBW pixel in the image partition and the saturation gain threshold corresponding to the image partition.

The fourth obtaining module 208 comprises a setting unit for setting the backlight luminance gain coefficient in the image partition based on the gray scale value of the RGBW pixel in the image partition; and a correcting unit for obtaining the target backlight luminance gain coefficient by correcting the backlight luminance gain coefficient in the image partition based on the saturation gain threshold.

The fifth obtaining module 209 is used for obtaining a gray scale compensation screen of the image partition based on the target backlight luminance gain coefficient of the image partition and the gray scale value of the RGBW pixel in the image partition.

The displaying module 210 is used for displaying based on the gray scale compensation screen of each the image partition.

From the above, in this application, converting the RGB display to the RGBW avoids problems of pure color darkness from different pixel gain inconsistencies, independently sets saturation gain value in different partitions based on specific screens, and maximizes and enhances penetration rate of W sub-pixel brightness gain effect.

As is understood by persons skilled in the art, the foregoing preferred embodiments of the present disclosure are illustrative rather than limiting of the present disclosure. It is intended that they cover various modifications and that similar arrangements be included in the spirit and scope of the present disclosure, the scope of which should be accorded the broadest interpretation so as to encompass all such modifications and similar structures.

What is claimed is:

1. A partitioned backlight display method of a red, green, blue, and white (RGBW) display device, comprising: dividing a red, green, and blue (RGB) image into a plurality of image partitions based on a backlight partition setting information according to display content on a screen of the display device, each image partition comprising a plurality of RGB pixels;

obtaining a gray scale value of each RGB pixel and converting the gray scale value to a hue, saturation, and value (HSV) space to obtain a saturation of the RGB pixel;

determining each of the RGB pixels being a high-purity color RGB pixel or a non-high-purity color RGB pixel based on the saturation and generating a determining result;

obtaining a saturation gain corresponding to each of the RGB pixels when each RGB pixel is pre-converted into a RGBW pixel;

obtaining a corrected target saturation gain by correcting the saturation gain of each RGB pixel based on the determining result and a visual luminance gain coefficient of each RGB pixel;

setting a saturation gain threshold corresponding to each image partition ,and performing an optimization process on the target saturation gain for each RGB pixel in the image partition based on the saturation gain threshold;

obtaining a gray scale value of the RGBW pixel by converting the RGB pixel into an RGBW pixel according to the target saturation gain after the optimization process;

obtaining a target backlight luminance gain coefficient based on the gray scale value of each RGBW pixel in the image partition and the saturation gain threshold corresponding to the image partition and outputting the target backlight luminance gain coefficient to the backlight drive unit to light the backlight of the corresponding image partition;

obtaining a gray scale compensation screen of the image partition based on the target backlight luminance gain coefficient of the image partition and the gray scale value of the RGBW pixel in the image partition; and controlling and displaying an image on the screen of the display device based on the gray scale compensation screen of each the image partition.

2. The partitioned backlight display method of the RGBW display device of claim 1, wherein the step of obtaining a target backlight luminance gain coefficient based on the gray scale value of each RGBW pixel in the image partition and the saturation gain threshold corresponding to the image partition comprises:

setting the backlight luminance gain coefficient in the image partition based on the gray scale value of the RGBW pixel in the image partition; and obtaining the target backlight luminance gain coefficient by correcting the backlight luminance gain coefficient in the image partition based on the saturation gain threshold.

3. The partitioned backlight display method of the RGBW display device of claim 2, wherein the step of performing an optimization process on the target saturation gain for each RGB pixel in the image partition based on the saturation gain threshold comprises:

adjusting the target saturation gain of the RGB pixel to the corresponding saturation gain threshold when the target saturation gain of the RGB pixel of the image partition is more than the corresponding saturation gain threshold.

4. The partitioned backlight display method of the RGBW display device of claim 1, wherein the step of obtaining a corrected target saturation gain by correcting the saturation gain of each RGB pixel based on the determining result and a visual luminance gain coefficient of each RGB pixel comprises:

obtaining a visual luminance gain coefficient x of each RGB pixel;

the target saturation gain of the RGB pixel has n=mx, when the RGB pixel is a high-purity color RGB pixel;

the target saturation gain n=m, when the RGB pixel is a non-high-purity color RGB pixel; and wherein, m is the saturation gain of the RGB pixel.

5. The partitioned backlight display method of the RGBW display device of claim 1, the step of obtaining a gray scale value of each RGB pixel and converting the gray scale value to a HSV space to obtain a saturation of the RGB pixel comprises:

normalizing the RGB pixels and obtaining a gray scale values of the normalized RGB pixels; and obtaining the saturation of the RGB pixel by converting the gray scale value of the RGB pixel to the HSV space.

6. A partitioned backlight display device for RGBW displaying, comprising:

a processor configured to execute computerized code to perform a method, the method comprising:

dividing a red, green, and blue (RGB) image into a plurality of image partitions based on a backlight partition setting information according to a display content on a screen of the display device, each image partition comprising a plurality of RGB pixels;

obtaining a gray scale value of each RGB pixel and converting the gray scale value to a hue, saturation, and value (HSV) space to obtain a saturation of the RGB pixel;

determining each of the RGB pixels being a high-purity color RGB pixel or a non-high-purity color RGB pixel based on the saturation and generating a determining result;

obtaining a saturation gain corresponding to each of the RGB pixels when each RGB pixel is pre-converted into a RGBW pixel;

obtaining a corrected target saturation gain by correcting the saturation gain of each RGB pixel based on the determining result and a visual luminance gain coefficient of each RGB pixel;

setting a saturation gain threshold corresponding to each image partition ,and performing an optimization process on the target saturation gain for each RGB pixel in the image partition based on the saturation gain threshold;

obtaining a gray scale value of the RGBW pixel by converting the RGB pixel into an RGBW pixel according to the target saturation gain after the optimization process;

obtaining a target backlight luminance gain coefficient based on the gray scale value of each RGBW pixel in the image partition and the saturation gain threshold corresponding to the image partition and outputting the target backlight luminance gain coefficient to the backlight drive unit to light the backlight of the corresponding image partition;

obtaining a gray scale compensation screen of the image partition based on the target backlight luminance gain coefficient of the image partition and the gray scale value of the RGBW pixel in the image partition; and controlling and displaying an image on the screen of the display device based on the gray scale compensation screen of each the image partition.

7. The partitioned backlight display device for RGBW displaying of claim 6, wherein the step of obtaining a target backlight luminance gain coefficient based on the gray scale value of each RGBW pixel in the image partition and the saturation gain threshold corresponding to the image partition and outputting the target backlight luminance gain coefficient to the backlight drive unit to light the backlight of the corresponding image partition comprises:

setting the backlight luminance gain coefficient in the image partition based on the gray scale value of the RGBW pixel in the image partition; and obtaining the target backlight luminance gain coefficient by correcting the backlight luminance gain coefficient in the image partition based on the saturation gain threshold.

8. The partitioned backlight display device for RGBW displaying of claim 7, wherein the step of setting a saturation gain threshold corresponding to each image partition ,and performing an optimization process on the target saturation gain for each RGB pixel in the image partition based on the saturation gain threshold comprises:

setting a saturation gain threshold corresponding to each image partition; and adjusting the target saturation gain of the RGB pixel to the corresponding saturation gain threshold when the target saturation gain of the RGB pixel of the image partition is more than the corresponding saturation gain threshold.

9. The partitioned backlight display device for RGBW displaying of claim 6, wherein the step of obtaining a corrected target saturation gain by correcting the saturation gain of each RGB pixel based on the determining result and a visual luminance gain coefficient of each RGB pixel comprises:

obtaining a visual luminance gain coefficient x of each RGB pixel;

setting the target saturation gain of the RGB pixel to mx, when the RGB pixel is a high-purity color RGB pixel;

a third setting unit for setting the target saturation gain to m when the RGB pixel is a non-high-purity color RGB pixel; and wherein, m is the saturation gain of the RGB pixel.

10. The partitioned backlight display device for RGBW displaying of claim 6, wherein the step of obtaining a gray scale value of each RGB pixel and converting the gray scale value to a hue, saturation, and value (HSV) space to obtain a saturation of the RGB pixel comprises:

normalizing the RGB pixels and obtaining a gray scale values of the normalized RGB pixels; and obtaining the saturation of the RGB pixel by converting the gray scale value of the RGB pixel to the HSV space.

11. A partitioned backlight display device for RGBW displaying comprising:

a processor configured to execute computerized code to perform a method, the method comprising:

dividing a red, green, and blue (RGB) image into a plurality of image partitions based on a backlight partition setting information according to a display content on a screen of the display device, each image partition comprising a plurality of RGB pixels;

obtaining a gray scale value of each RGB pixel and converting the gray scale value to a hue, saturation, and value (HSV) space to obtain a saturation of the RGB pixel;

determining each of the RGB pixels being a high-purity color RGB pixel or a non-high-purity color RGB pixel based on the saturation and generating a determining result;

obtaining a saturation gain corresponding to each of the RGB pixels when each RGB pixel is pre-converted into a RGBW pixel;

obtaining a corrected target saturation gain by correcting the saturation gain of each RGB pixel based on the determining result and a visual luminance gain coefficient of each RGB pixel;

setting a saturation gain threshold corresponding to each image partition, and performing an optimization process on the target saturation gain for each RGB pixel in the image partition based on the saturation gain threshold;

obtaining a gray scale value of the RGBW pixel by converting the RGB pixel into an RGBW pixel according to the target saturation gain after the optimization process;

obtaining a target backlight luminance gain coefficient based on the gray scale value of each RGBW pixel in the image partition and the saturation gain threshold corresponding to the image partition and outputting the target backlight luminance gain coefficient to the backlight drive unit to light the backlight of the corresponding image partition;

obtaining a gray scale compensation screen of the image partition based on the target backlight luminance gain coefficient of the image partition and the gray scale value of the RGBW pixel in the image partition; and controlling and displaying an image on the screen of the display device based on the gray scale compensation screen of each the image partition;

wherein the step of obtaining a target backlight luminance gain coefficient based on the gray scale value of each RGBW pixel in the image partition and the saturation gain threshold corresponding to the image partition and outputting the target backlight luminance gain coefficient to the backlight drive unit to light the backlight of the corresponding image partition comprising:

setting the backlight luminance gain coefficient in the image partition based on the gray scale value of the RGBW pixel in the image partition; and obtaining the target backlight luminance gain coefficient by correcting the backlight luminance gain coefficient in the image partition based on the saturation gain threshold;

wherein the step of setting a saturation gain threshold corresponding to each image partition ,and performing an optimization process on the target saturation gain for each RGB pixel in the image partition based on the saturation gain threshold comprising:

setting a saturation gain threshold corresponding to each image partition; and adjusting the target saturation gain of the RGB pixel to the corresponding saturation gain threshold when the target saturation gain of the RGB pixel of the image partition is more than the corresponding saturation gain threshold;

wherein the step of obtaining a corrected target saturation gain by correcting the saturation gain of each RGB pixel based on the determining result and a visual luminance gain coefficient of each RGB pixel comprising:

obtaining a visual luminance gain coefficient x of each RGB pixel;

setting the target saturation gain of the RGB pixel to mx, when the RGB pixel is a high-purity color RGB pixel;

setting the target saturation gain to m when the RGB pixel is a non-high-purity color RGB pixel; and wherein, m is the saturation gain of the RGB pixel; and wherein the step of obtaining a gray scale value of each RGB pixel and converting the gray scale value to a hue, saturation, and value (HSV) space to obtain a saturation of the RGB pixel comprising:

normalizing the RGB pixels and obtaining a gray scale values of the normalized RGB pixels; and obtaining the saturation of the RGB pixel by converting the gray scale value of the RGB pixel to the HSV space.

* * * * *